US012796759B2

(12) United States Patent
Ahn et al.

(10) Patent No.: US 12,796,759 B2
(45) Date of Patent: Nov. 17, 2026

(54) APPLICATOR IN COMBINATION WITH ARTIFICIAL EYELASH EXTENSION SYSTEM

(71) Applicant: KISS NAIL PRODUCTS, INC

(72) Inventors: Kichul Ahn, Port Washington, NY (US); Mihee Kim, Port Washington, NY (US)

(73) Assignee: KISS NAIL PRODUCTS, INC, Port Washington, NY (US)

( * ) Notice: Subject to any disclaimer, the term of this patent is extended or adjusted under 35 U.S.C. 154(b) by 246 days.

(21) Appl. No.: 18/238,514

(22) Filed: Aug. 27, 2023

(65) Prior Publication Data

US 2025/0064158 A1 Feb. 27, 2025

(51) Int. Cl.
*A41G 5/02* (2006.01)
*A41G 5/00* (2006.01)

(52) U.S. Cl.
CPC ..... *A41G 5/02* (2013.01); *A41G 5/008* (2013.01); *A41G 5/0086* (2013.01)

(58) Field of Classification Search
CPC ..... A45D 2/48; A45D 40/30; A45D 2200/10; A41G 5/02; A41G 5/0086
See application file for complete search history.

(56) References Cited

U.S. PATENT DOCUMENTS

| | | | | | |
|---|---|---|---|---|---|
| 3,935,872 | A * | 2/1976 | Aylott | A41G 5/02 | 132/216 |
| 4,018,336 | A * | 4/1977 | Aylott | A41G 5/02 | 206/757 |
| 5,052,417 | A * | 10/1991 | Cordova | A45D 40/00 | 132/319 |
| 8,424,542 | B1 * | 4/2013 | Han | A41G 5/02 | 132/218 |
| 9,788,567 | B2 * | 10/2017 | Abe | A23K 20/168 | |
| 10,159,292 | B2 * | 12/2018 | Ahn | A41G 5/02 | |
| 11,219,260 | B2 * | 1/2022 | Lotti | A41G 5/02 | |
| 2017/0231309 | A1 | 8/2017 | Han | | |
| 2022/0053862 | A1 | 2/2022 | Ahn et al. | | |
| 2022/0225713 | A1 | 7/2022 | Ahn et al. | | |
| 2022/0338585 | A1 * | 10/2022 | Chipman | A41G 5/02 | |

FOREIGN PATENT DOCUMENTS

| | | | | |
|---|---|---|---|---|
| GB | 487918 | A * | 6/1938 | A45D 40/30 |
| KR | 10-2014-0114739 | A | 9/2014 | |
| KR | 10-2016-0064541 | A | 6/2016 | |

(Continued)

*Primary Examiner* — Rachel R Steitz
(74) *Attorney, Agent, or Firm* — PnK IP LLC

(57) ABSTRACT

An applicator for an artificial eyelash extension system having a plurality of filaments to which a first adhesive is disposed on a first surface thereof and to be attached to a user's natural eyelashes, the applicator includes: a tip portion having an adhesive area located on a predetermined portion of an upper surface thereof and a second adhesive applied to the adhesive area; and a tab portion connected to the tip portion and configured to be gripped by a user, wherein: a second surface of the filaments of the artificial eyelash extension system is temporarily fixed to the second adhesive, and a second adhesive strength of the second adhesive is smaller than a first adhesive strength of the first adhesive.

15 Claims, 14 Drawing Sheets

(56) References Cited

FOREIGN PATENT DOCUMENTS

| | | | |
|---|---|---|---|
| KR | 10-2016-0090493 | | 8/2016 |
| KR | 10-2023-0052974 | A | 4/2023 |
| KR | 10-2023-0075509 | A | 5/2023 |
| WO | 2022-040640 | A1 | 2/2022 |
| WO | 2022-072351 | A1 | 4/2022 |

* cited by examiner

APPLICATOR IN COMBINATION WITH ARTIFICIAL EYELASH EXTENSION SYSTEM

BACKGROUND

Field

Embodiments of the invention relate generally to an applicator for artificial eyelashes, and more particularly, to an applicator for ready-to-use artificial eyelash extension systems.

Discussion of the Background

Artificial eyelash extension systems are well-known products used to improve the look of a user's natural lash line through the addition of lash length and/or volume. Such artificial eyelash extension systems typically comprise a lash line support strip with eyelash filaments extending therefrom. The eyelash filaments can be made from mink, synthetic materials, horsehair, and in some instances, human hair. Artificial eyelash extension systems are typically applied by spreading adhesive on or around the lash line support strip of the eyelash extension systems and pressing the lash line support strip to a user's lash line or proximate thereto. However, such traditional artificial eyelash extension systems can be challenging to apply and require that a user have both the extension systems and specialized adhesives at hand to use them.

More recently, do-it-yourself, under-lash eyelash extension systems have been developed. In these systems, an eyelash extension system is glued to the underside of a user's natural eyelashes in a similar fashion to more traditional above artificial eyelash extension systems. The do-it-yourself systems often come in small sections (e.g., wisp lashes, cluster lashes, individual lashes), allowing for an inexperienced user to apply the eyelash extension systems without the difficulty of aligning a longer, single strip of eyelash extension systems. However, these do-it-yourself systems still require the user to have and apply specialty adhesive either to their lashes or to the eyelash extension system before use.

Further, conventionally, when attaching the artificial eyelash extension systems to a user's natural eyelash, an adhesive-coated lash line support strip was brought into close contact with the natural eyelash while holding one side of the filaments with a tool such as tweezers or a finger. However, it was difficult to precisely attach the lash line support strip to the natural eyelash when holding only one side of the filaments.

A need exists in the art for artificial eyelash extension systems that eliminate the difficulties of prior art systems. A need also exists for an applicator for the artificial eyelash extension system that easily facilitates a user to apply eyelash extension systems without the drawbacks of existing systems.

The above information disclosed in this Background section is only for understanding of the background of the inventive concepts, and, therefore, it may contain information that does not constitute prior art.

SUMMARY

Applicators for a ready-to-use artificial eyelash extension system constructed according to the principles and implementations of the invention are capable of easily attaching and detaching artificial eyelash extension systems to a user's natural eyelash with one touch by the user. For example, the applicator for the ready-to-use artificial eyelash extension system having filaments to which a first adhesive is disposed on a first surface thereof and to be attached to the user's natural eyelash, includes: a tip portion having a second adhesive to temporarily fix the filaments, and a tab portion connected to the tip portion and configured to be gripped by the user, wherein an adhesive strength of the second adhesive is smaller than that of the first adhesive.

Further, ready-to-use artificial eyelash extension systems constructed according to the principles and implementations of the invention are capable of overcoming many of the drawbacks in the prior art. For example, the ready-to-use artificial eyelash extension system has pre-applied adhesive elements before being packaged for sale to a user as such there is no need for any additional supplies such as glue. Accordingly, the user can apply the ready-to-use artificial eyelash extension system quickly and with one hand by using the applicator for a ready-to-use artificial eyelash extension system. The pre-applied adhesive may be droplets of adhesive applied to the eyelash filaments of the artificial eyelash extension system.

Other embodiments of the ready-to-use artificial eyelash extension systems are capable for being easily applied with the applicator by a user onto their natural lashes as such filaments adheres directly to the natural eyelashes of a user at a position not directly adjacent to the eyelid of a user. Since adhering the artificial eyelash extension system to the natural eyelashes of a user in a position spaced from the eyelid, the user avoids any pain and skin irritation associated with lash systems that are applied to the skin of the eyelid or adjacent thereto.

Additional features of the inventive concepts will be set forth in the description which follows, and in part will be apparent from the description, or may be learned by practice of the inventive concepts.

According to one aspect of the invention, an applicator for an artificial eyelash extension system having a plurality of filaments to which a first adhesive is disposed on a first surface thereof and to be attached to a user's natural eyelashes, the applicator includes: a tip portion having an adhesive area located on a predetermined portion of an upper surface thereof and a second adhesive applied to the adhesive area; and a tab portion connected to the tip portion and configured to be gripped by a user, wherein: a second surface of the filaments of the artificial eyelash extension system is temporarily fixed to the second adhesive, and a second adhesive strength of the second adhesive is smaller than a first adhesive strength of the first adhesive.

The tip portion and the tab portion may be connected in a bent form with a predetermined angle.

The predetermined angle may be an acute angle smaller than 90 degrees.

At least one of the tip portion and the tab portion may have a curved shape which is convex outward when viewed in cross section.

The tip portion may include a first edge located adjacent to a support strip of the artificial eyelash extension system to be attached thereof and a second edge located on the opposite side of the first edge and connected to the tab portion.

The first edge may have a first width and the second edge has a second width smaller than the first width.

The tip portion may have a trapezoidal shape in which the width becomes narrower from the first edge to the second edge.

The tab portion may include the second edge connected to the tip portion and a third edge located on the opposite side of the second edge, and the third edge has a third width greater than the second width.

The tip portion may have a first length and the tab portion has a second length greater than the first length.

The tab portion may have an opening at the center thereof.

The tab portion may have an elongated circular shape with curved edges when viewed in plan.

The adhesive area of the tip portion may be spaced apart from the first edge by a first distance, and portions of filaments to which the first adhesive are applied are positioned between the first edge and the adhesive area.

The first adhesive disposed on the first surface of the filaments and the second adhesive disposed on the adhesive area may be spaced apart by a second distance when viewed in cross section.

The first adhesive and the second adhesive may not overlap each other.

The artificial eyelash extension system may include a ready-to-use artificial eyelash extension system having the first adhesive which is a pre-applied adhesive element before being packaged for sale to a user.

The ready-to-use artificial eyelash extension system may include: the plurality of filaments, each having a base and a tip; a support strip attached to the bases of the filaments; and the first adhesive disposed on at least one of the support strip and the plurality of filaments.

The first adhesive may be applied at a position between the support strip and one-half the filaments' average length away from the support strip.

The first adhesive may include an adhesive that retains its stickiness during storage of the artificial eyelash extension system.

The first adhesive may be applied continuously from a position between the support strip and a one-half of the filaments' average length to a distance that is equal to or less than one-half of the filaments' average length.

The first adhesive may be a double-sided tape.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION

Figure 1A:
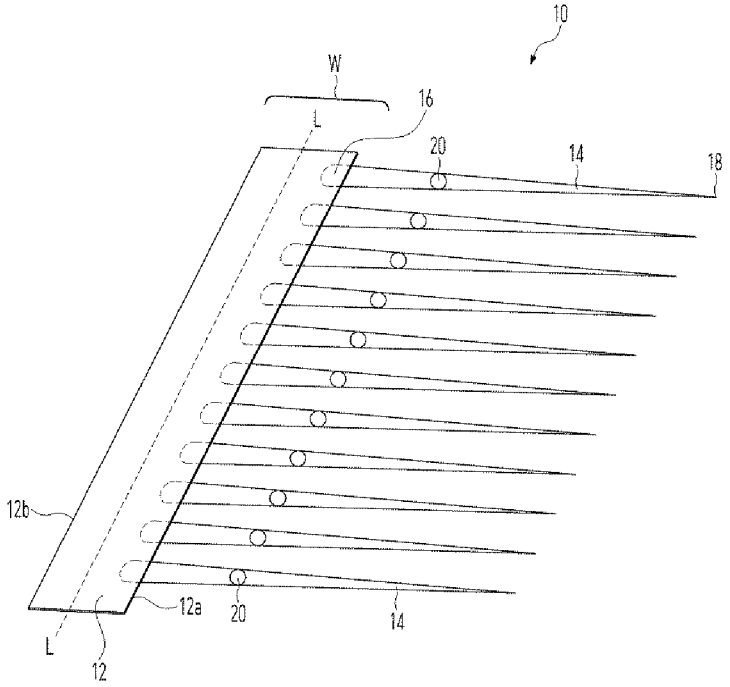
FIGS. 1A to 1D are perspective views of embodiments of an artificial eyelash extension system having pre-applied adhesive elements constructed according to the principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

In various embodiments, the invention provides a ready-to-use (or apply) eyelash extension system and an applicator for the ready-to-use eyelash extension system. The eyelash extension system comprises eyelash filaments extending from an eyelash support strip wherein the filaments feature adhesive elements for attachment to the natural eyelashes of a user. The eyelash extension system may be referred to as a lash extension system or an artificial eyelash extension system.

The foregoing summary, as well as the following detailed description of certain embodiments of the present invention, will be better understood when read in conjunction with the appended drawings.

FIGS. 1A to 1D are perspective views of embodiments of an artificial eyelash extension system having pre-applied adhesive elements constructed according to the principles of the invention.

Figure 1B:
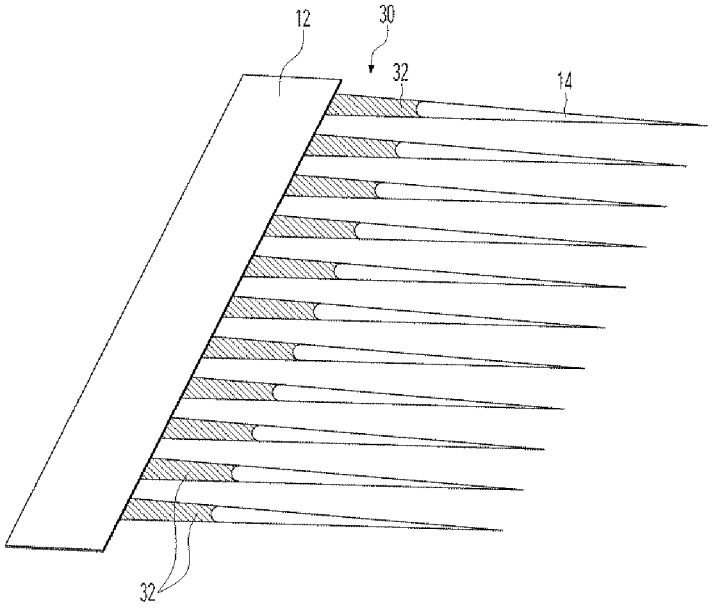
Figure 1C:
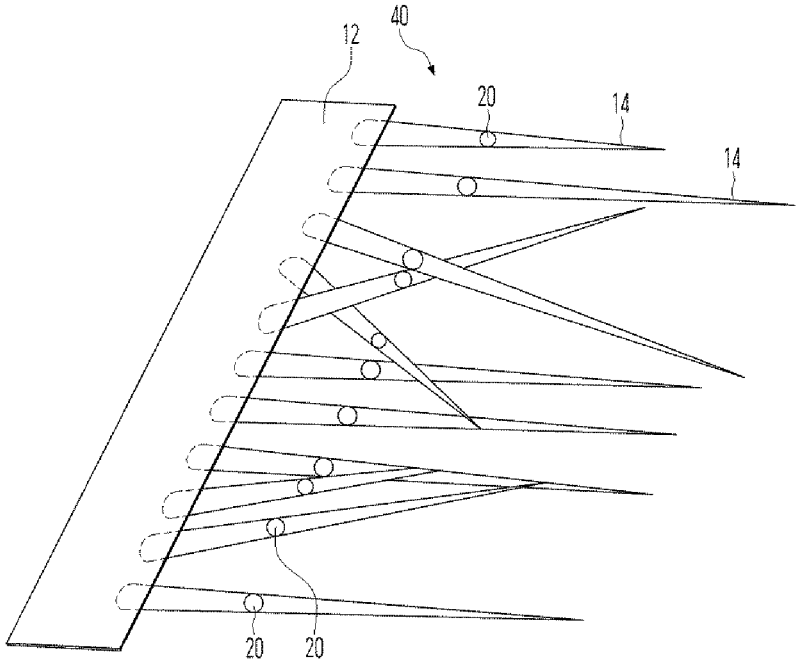
Figure 1D:
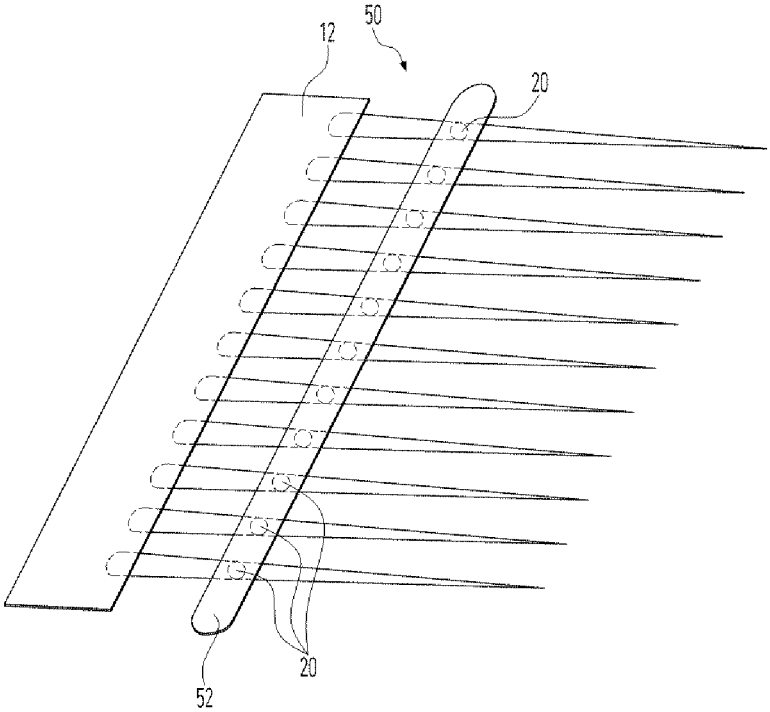

Specifically, FIG. 1A depicts a perspective view of an eyelash extension system having pre-applied adhesive elements, FIG. 1B depicts a perspective view of an alternative embodiment of an eyelash extension system having pre-applied adhesive elements, FIG. 1C depicts a perspective view of another alternative embodiment of an eyelash extension system having pre-applied adhesive elements, and FIG. 1D depicts a perspective view an embodiment of an eyelash extension system having pre-applied adhesive elements overlaid by a temporary backing.

The phrases "lash," "artificial eyelash," and "eyelash," as used herein, are interchangeable and refer to an apparatus that is not part of the wearer's body unless specifically indicated otherwise (e.g., phrases such as "natural eyelash" or "user's eyelash" refer to a part of the wearer's body).

Turning to the figures, FIG. 1A depicts a perspective view of one embodiment 10 of the invented lash extension system. The lash extension system may include a plurality of artificial eyelash filaments, a support strip, and an adhesive element. The lash extension system comprises a support strip 12 having a length L and width W. (The width W is a representation and not drawn to scale and may be narrower.) The support strip 12 may be attached to the bases of the eyelash filaments. The support strip 12 has a leading edge from which eyelash filaments 14 extend. The width W of the support strip 12 extends between the proximal edge 12*a* and the distal edge 12*b* of the support strip 12. As shown in FIG. 1A, the eyelash extension system 10 features eyelash filaments 14 extending between a base 16 and a tip 18. The bases 16 of the eyelash filaments 14 are embedded within and/or adhered to the support strip 12. In the exemplary embodiment shown in FIG. 1A, the bases 16 of the eyelash filaments 14 are spaced apart, with the eyelash filaments 14 extending away from the support strip 12 such that the lengths of the eyelash filaments 14 are substantially parallel and extending in a direction that is substantially perpendicular to the length L of the support strip 12.

While in FIG. 1A, the width W of the support strip 12 is about ten percent of the length of the filaments 14; in other embodiments, the width W of the support strip 12 is much smaller than the eyelash filaments 14. For example, in some embodiments, the width W is less than five percent of the length of the eyelash filaments 14. The larger width W is shown only for illustration purposes and to be able to show the structure of the support strip 12.

As can be appreciated from FIG. 1A, the eyelash filaments 14 have a variable length and arrangement. Some eyelash filaments 14 are substantially parallel, while other eyelash filaments 14 cross each other. The eyelash filaments 14 will have an average length resulting in a desired overall appearance of length of the eyelashes after application, in one embodiment.

The eyelash filaments 14 are made from conventional materials used in eyelash extensions. Suitable materials include materials having an appearance similar to human eyelashes. Exemplary materials include mink, horsehair, human hair, synthetic materials, and combinations thereof.

Materials used in the support strip 12 are well known in the art and include any suitable material for the attaching of the bases of eyelash filaments 14. Exemplary materials include PBT, nylon, cotton, silk, and combinations thereof.

A salient feature of the invented lash extension system 10 is the inclusion of an adhesive element 20 disposed on the eyelash filaments 14. The adhesive element 20 may be applied before the artificial eyelash extension system is packaged for sale to a user, to the plurality of the eyelash filaments. The adhesive element 20 may be applied at a position between the support strip and one-half the eyelash filaments' average length away from the support strip. The adhesive element 20 may be applied continuously to a predetermined location that is less than half of the eyelash filaments' average length away from the support strip. At least some of the adhesive element 20 is applied to the eyelash filaments 14 at the time of manufacturing of the system.

FIG. 1A shows the adhesive element 20 disposed on each eyelash filament 14. The depiction of the location of the adhesive element 20 is meant to be exemplary and non-limiting. In several figures, the adhesive element 20 is shown as discrete droplets of adhesive. However, that depiction should not be limiting. In FIG. 1A, all eyelash filaments 14 are shown with an applied adhesive element 20. In some embodiments, not all eyelash filaments 14 will receive adhesive. In one embodiment, between one-half and three-fourths of all eyelash filaments comprising the artificial eyelash extension system receive the adhesive element. In other embodiments, the plurality of eyelash filaments comprises multiple layers, and only one layer of eyelash filaments receives the adhesive.

A benefit of the adhesive element 20 is that the lash extension system is ready to use without applying external adhesive, as will be described below.

While the figures depict the lash extension system as being used in conjunction with a full-strip artificial eyelash extension system, the same ready-to-use adhesive concepts may be used in conjunction with artificial eyelash extension systems of various styles, lengths, and sizes, such as smaller "wisp" eyelash systems (e.g., KISS Falscara Eyelash made by Kiss Products, Inc. located in Port Washington, NY) that are segmented versions of a full-strip eyelash systems and whose support strip lengths are one-half to one-fifth of a full-strip eyelash extension system's support strip length, or even smaller "cluster" eyelash systems (e.g., KISS Lash Couture LuXtensions, also made by Kiss Products, Inc.), or the smallest "flare" or "individual" eyelash systems (e.g., KISS i•ENVY Ultra Black Flare Short/Medium/Long, KISS i•ENVY Ultra Black 3D Individual Lash Medium/Long, all of which are also made by Kiss Products, Inc.) that may include only a few eyelash filaments 14 attached together at their bases.

The adhesive element 20 can be disposed on a plurality of eyelash filaments 14 across the entire length L of the support strip 12 or some fraction of the eyelash filaments 14, such as two-thirds, one-half, or one-third. It will be apparent to one having ordinary skill in the art that the fraction of eyelash filaments 14 having the adhesive elements disposed thereon can be adjusted according to the weight of the section of lash extension system 10 being used. For example, a lash extension system 10 designed for application to all of a user's natural lashes may require that all the eyelash filaments 14 have corresponding adhesive elements. Alternatively, a lash extension system 10 designed for attachment to some lesser portion of a user's natural lashes may only require that one half or a smaller proportion of eyelash filaments 14 bear corresponding adhesive elements.

As depicted in FIG. 1A, the adhesive element 20 can be discrete applications or droplets of an adhesive. The adhesive element 20 may be comprised of multiple discrete droplets of adhesive. The adhesive element 20 may be applied to a first surface (e.g., an upward-facing surface) of the eyelash filaments. In an embodiment, the adhesive element 20 is disposed at approximately the same position along the length of each eyelash filaments 14 away from the support strip 12. FIG. 1A shows the adhesive element 20 as small, flat sections of adhesive overlaying a portion of the eyelash filaments 14. In alternative embodiments, the adhesive element 20 may be non-cured droplets of adhesive.

Suitable adhesives for use in the instant invention include any adhesive that can be applied to the eyelash filaments 14 and retain stickiness while the lash extension system 10 is stored in packaging. Suitable adhesives can be applied to eyelash filaments 14, and then stored without drying.

The suitable adhesives may be, for example, a solid adhesive. An example of a solid adhesive is described hereinafter.

A mixture of a polychloroprene-based adhesive (Neoprene rubber) of about 10 to 20% in a solid type and an organic solvent of about 60 to 80% containing Toluene, MEK, and Distillates (petroleum) is prepared and dried. When dried, it forms a basis for a solid adhesive that may be suitable for the adhesive of the present invention. Such a composition stays solid at room temperature and melts when placed in an oven that is heated to about 180 degrees Celsius.

FIG. 1A shows the adhesive element 20 as discrete applications of adhesive on the eyelash filaments 14. An alternative embodiment 30 is shown in FIG. 1B. The lash extension system 30 shown in FIG. 1B features adhesive elements 32 extending continuously along the length of the eyelash filaments 14 starting from the support strip 12 to a defined position. In some embodiments, the length along the eyelash filaments 14 covered by the adhesive elements 32 is customized to the weight and other attributes of a lash extension set using the invented system. Preferably, the adhesive elements 32 will extend continuously on the first half to one-third of the average length of the eyelash filaments that extend from the support strip (i.e., the length of the eyelash filament embedded in the support strip is not included in this length). In alternative embodiments, the adhesive elements 32 are disposed continuously along lengths of the eyelash filaments 14 where the length is not proximate to the support strip (i.e., middle and tip portions of eyelash filaments). Yet, in another embodiment, the adhesive elements 32 may be applied continuously from a position between the support strip 12 and one-half of the eyelash filaments' average length. In other embodiments, the position is selected up to one-half of the eyelash filaments' average length from the support strip 12.

FIGS. 1A and 1B show the eyelash filaments 14 in the same direction and having similar lengths. In alternative embodiments such as the exemplary eyelash extension section 40 shown in FIG. 1C, the eyelash filaments 14 extend in different directions from the support strip 12 and can have different lengths. The eyelash filaments may extend from the support strip 12 such that at least some of the eyelash filaments overlap or cross one another. In one embodiment, the eyelash filaments may extend from the support strip 12 such that at least one-quarter of the eyelash filaments overlap or cross one another. The embodiment shown in FIG. 1C can utilize both the continuous and discrete applications of adhesive elements shown in FIGS. 1A and 1B. For example, the embodiment of FIG. 1C shows the adhesive element 20 much as show in FIG. 1A.

FIG. 1D shows yet another embodiment 50 of the invented eyelash extension system. In this embodiment, the adhesive elements 20 (or like adhesive element 32 from FIG. 1 B) are overlaid with an elongated substrate 52. The elongated substrate 52 may further include removably overlaying the adhesive elements. The elongated substrate 52 is a thin piece of material that is in removable contact with the adhesive elements 20 disposed on the eyelash filaments 14 extending from the support strip 12. This temporary overlayment of the adhesive elements 20 maintains the cleanliness of the adhesive elements 20 on the lash extension system 50 before a user is ready to apply the eyelash extension system and prevents the system from tangling or getting stuck to undesired surfaces or objects.

In the embodiment depicted in FIG. 1D, the bond between the eyelash filaments 14 and the adhesive elements 20 is stronger than the bond between the adhesive elements 20 and the elongated substrate 52. This relationship of bond strength corresponds with the ability of a user to peel off the elongated substrate 52 from the adhesive elements 20 without removing the adhesive elements 20 from the eyelash filaments 14 or otherwise damaging the lash extension system 50.

In an embodiment, the strength of the adhesion between the adhesive elements 20 and the elongated substrate 52 is tuned by selecting the thickness of an adhesive applied to the surface of the elongated substrate 52 that contacts the adhesive elements 20. Using particular adhesives on the elongated substrate 52, applying a thin layer of adhesive allows for easy removal of the elongated substrate 52 from the adhesive elements 20, while a thicker layer of adhesive will increase the strength of the bond between the elongated substrate 52 and the adhesive elements 20.

In another embodiment, the strength of the adhesion between the adhesive elements 20 and the elongated substrate 52 is tuned by applying a pre-glue (an adhesive that does not completely coalesce during storage of the stored eyelash extension system) to the surface of the elongated substrate 52 that is in contact with the adhesive elements 20.

FIGS. 1A to 1D show the adhesive elements applied on a first surface (e.g., an upward-facing surface) of the eyelash filaments 14 of an eyelash extension system. In these configurations, the invented eyelash extension system is removably attached to the underside of a user's natural lashes. In alternative embodiments, the adhesive elements are disposed on a second surface (e.g., a downward-facing surface) of the eyelash filaments 14 of an eyelash extension system. In this alternative embodiment, the eyelash extension system can be removably attached to the top of a user's natural lashes.

Figure 2:
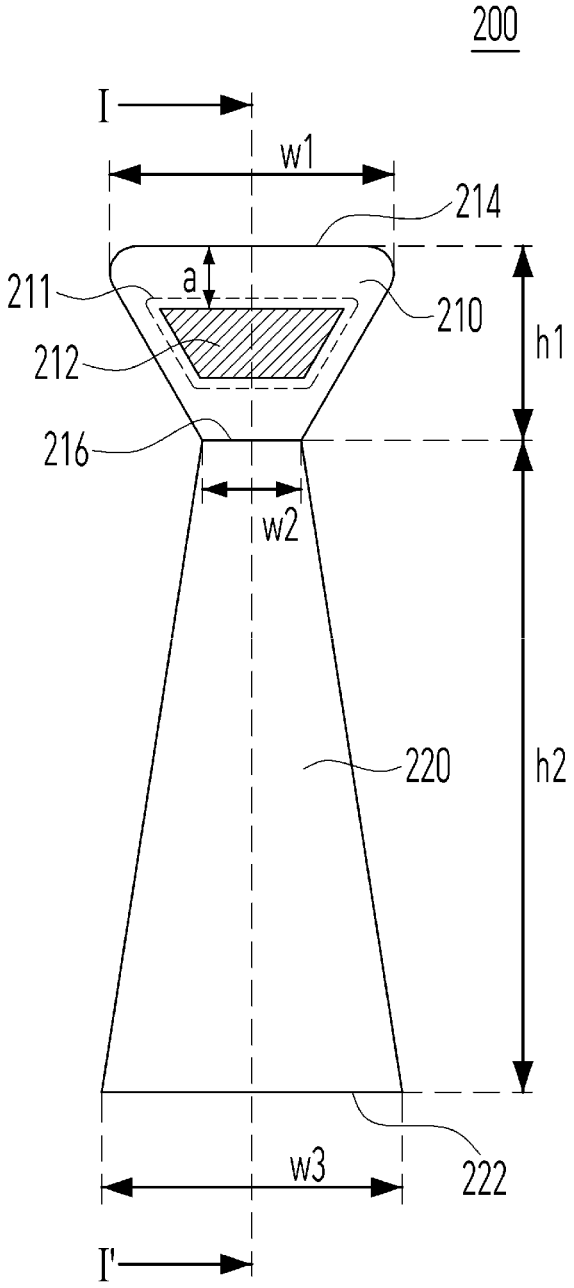
FIG. 2 is a plan view of an embodiment of an applicator for artificial eyelash extension systems constructed according to the principles of the invention.
Figure 3A:
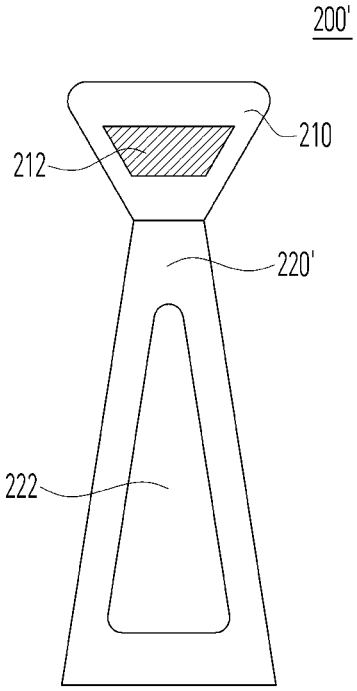
FIGS. 3A and 3B are plan views of other embodiments of the applicator for artificial eyelash extension systems of FIG. 2.
Figure 3B:
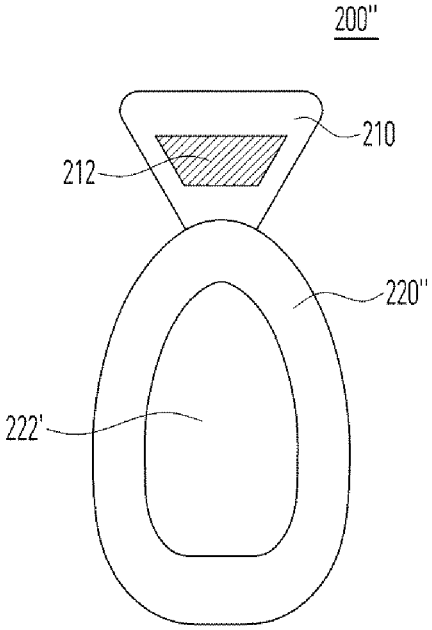

FIG. 2 is a plan view of an embodiment of an applicator for artificial eyelash extension systems constructed according to the principles of the invention; FIGS. 3A and 3B are plan views of other embodiments of the applicator for artificial eyelash extension systems of FIG. 2, and FIG. 4A and 4B are cross-sectional views of the applicator for artificial eyelash extension systems taken along line I-I' of FIG. 2.

Figure 4A:
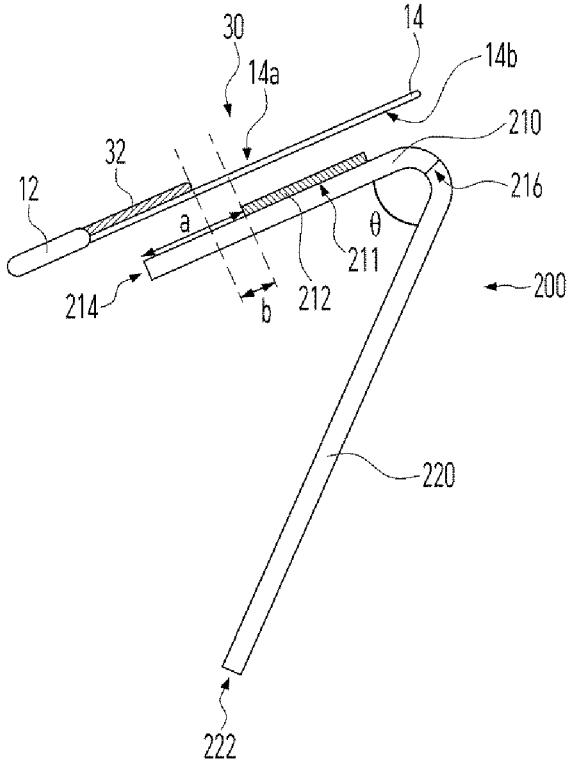
FIG. 4A and 4B are cross-sectional views of the applicator for artificial eyelash extension systems taken along line I-I' of FIG. 2.
Figure 4B:
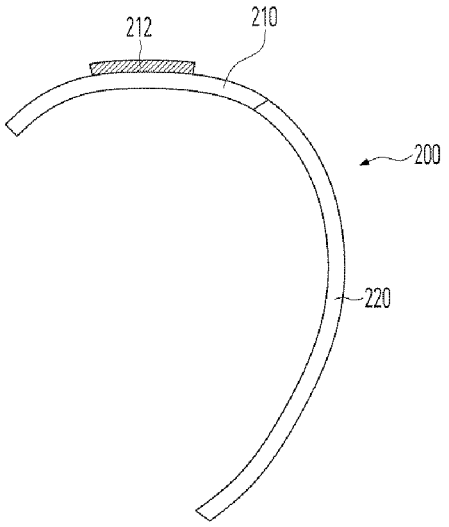

The applicator 200 shown in FIG. 2 and FIGS. 4A and 4B is only an embodiment; as such embodiments of the present invention are not necessarily limited thereto.

An applicator for artificial eyelash extension systems according to an embodiment of the invention is an applicator suitable for the ready-to-use artificial eyelash extension systems (10, 30, 40, and 50 of FIGS. 1A to 1D) including filaments 14 to which first adhesives (adhesive elements 20, 32) are applied to a first surface (e.g., an upward-facing surface) thereof and to be attached to a user's natural eyelashes.

More specifically, referring to FIGS. 2 and 4A, the applicator 200 according to an embodiment includes a tip portion 210 having an adhesive area 211 located on a predetermined portion of an upper surface thereof and a second adhesive 212 applied to the adhesive area 211; and a tab portion 220 connected to the tip portion 210 and configured to be gripped by a user. As shown in FIG. 4A, a second surface 14*b* (e.g., a downward-facing surface) of the filaments 14 of the artificial eyelash extension system 30 is temporarily fixed to the second adhesive 212.

Also, referring to FIG. 4A, when viewed in cross section, the tip portion 210 and the tab portion 220 may be connected in a bent form with a predetermined angle θ. For example, the predetermined angle θ may be an acute angle smaller than 90 degrees as shown in FIG. 4A, but embodiments are not necessarily limited thereto. That is, the connection angle between the tip portion 210 and the tab portion 220 may be substantially 90 degrees or greater than 90 degrees and less than 180 degrees.

In addition, FIG. 4B is a cross-sectional view of the applicator shown in FIG. 2 along the line II' according to another embodiment. Referring to FIG. 4B, the tip portion 210 and the tab portion 220 of the applicator 200 are implemented in a curved shape that is convex outward when viewed in cross section unlike the embodiment shown in FIG. 4A.

The applicator 200 according to an embodiment of the invention is characterized in that a second adhesive strength of the second adhesive 212 is smaller than a first adhesive strength of the first adhesive 20 and/or 32, thereby easily attaching and detaching artificial eyelash extension systems to a user's natural eyelash with one touch by the user.

In other words, when the user holds the tab portion 220 and pushes the tip portion 210 toward the user's natural eyelashes, the first surfaces of the filaments 14 on which the first adhesive 20 are attached to the user's natural eyelashes. Then, due to the relatively lower adhesive strength of the second adhesive 212 applied between the second surface of the filaments 14 and the adhesive area of the tip portion 210, the user can easily detach the applicator 200 from the lash extension system 30.

Referring to FIGS. 2A and 4A, the tip portion 210 includes a first edge 214 located adjacent to the support strip 12 of the artificial eyelash extension system 30 to be attached thereof and a second edge 216 located on the opposite side of the first edge 214 and connected to the tab portion 220.

In an embodiment, the first edge 214 may have a first width w1, and the second edge 216 may have a second width w2 smaller than the first width w1. For example, the tip portion 210 may have a trapezoidal shape in which the width becomes narrower from the first edge 214 to the second edge 216, and the tip portion 210 may have a first length h1 as shown in FIG. 2. However, embodiments of the present invention are not necessarily limited thereto. That is, the second width w2 may be substantially same as the first width w1, or the second width w2 may be greater than the first width w1.

Further, as shown in FIG. 2, the adhesive area 211 of the tip portion 210 is spaced apart from the first edge 212 by a first distance a, and as shown in FIG. 4A, the second surface 14*b* (downward-facing surface) of the filaments 14 of the artificial eyelash extension system 30 is attached (or temporarily fixed) by the second adhesive 212 disposed on the adhesive area 211.

More specifically, referring to FIG. 4A, in the artificial eyelash extension system 30 which is temporality fixed to the tip portion 210, the first adhesive 32 is disposed on the first surface 14*a* (upward-facing surface) of the filament 14. In the embodiment of FIG. 4A, as like in the embodiment in FIG. 1B, the first adhesive 32 (adhesive element) is continuously applied along the length of the filament 14 starting from the support strip 12 to a predetermined position of the filament 14, but embodiments are not necessarily limited thereto.

As shown in FIG. 4A, portions of filaments 14 to which the first adhesive 32 are applied may be positioned between the first edge 214 and the adhesive area 211. For example, when viewed in cross section, the first adhesive 32 disposed on the first surface 14*a* of the filaments 14 and the second adhesive 212 disposed on the adhesive area 211 of the tip portion 210 may be spaced apart by a second distance b as shown in FIG. 4A. Therefore, when viewed in cross section, the first adhesive 32 and the second adhesive 212 do not overlap each other.

Referring to FIG. 2 again, the tab portion 220 includes the second edge 216 connected to the tip portion 210 and a third edge 222 located on the opposite side of the second edge 216.

In an embodiment, the second edge 216 may have the second width w2, and the third edge 222 may have a third width w3 greater than the second width w2. For example, the tab portion 220 may have a shape in a trapezoidal shape with a width increasing from the second edge 216 to the third edge 222, and the tab portion 220 may have a second length h2 greater than the first length h1 of the tip portion 210. However, embodiments of the present invention are not necessarily limited thereto. That is, the second width w2 may be substantially same as the third width w3, or the second width w2 may be greater than the third width w3.

As such, the tab portion 220 has a longer shape than the tip portion 210, so that the artificial eyelash extension system 30 can be attached to the user's natural eyelashes while the user more stably grips the applicator 200.

FIGS. 3A and 3B are plan views of other embodiments of the applicator 200' and 200". Specifically, compared with the embodiment in FIG. 2, the shape and operation of the tip portion 210 is same as that of the embodiment of FIG. 2, but the shape of the tab portion 220', 220" is different from that of the embodiment of FIG. 2. Therefore, the same components are denoted by the same reference numerals, and descriptions of the same components are omitted.

The tab portion 220' of the applicator 200' shown in FIG. 3A is different from the tab portion 220 of the applicator 200 shown in FIG. 2 in that an opening 222 is formed at the center of the tab portion 220'.

In the same manner, the tab portion 220" of the applicator 200" shown in FIG. 3B is different from the tab portion 220 of the applicator 200 shown in FIG. 2 and the tab portion 220' of the applicator shown in FIG. 3A, that is, in that the tab portion 220" is not a polygonal shape (e.g., a trapezoid shape) but has an elongated circular shape with curved edges. At this time, although it is shown in FIG. 3B that the opening 222' is formed at the center of the tab portion 220", the embodiment is not limited thereto.

As in the embodiment shown in FIGS. 3A and 3B, an opening 222, 222' is formed in the center of the tab portion and/or implemented in an elongated circular shape, so that the user can grip the applicator more stably.

Figure 5:
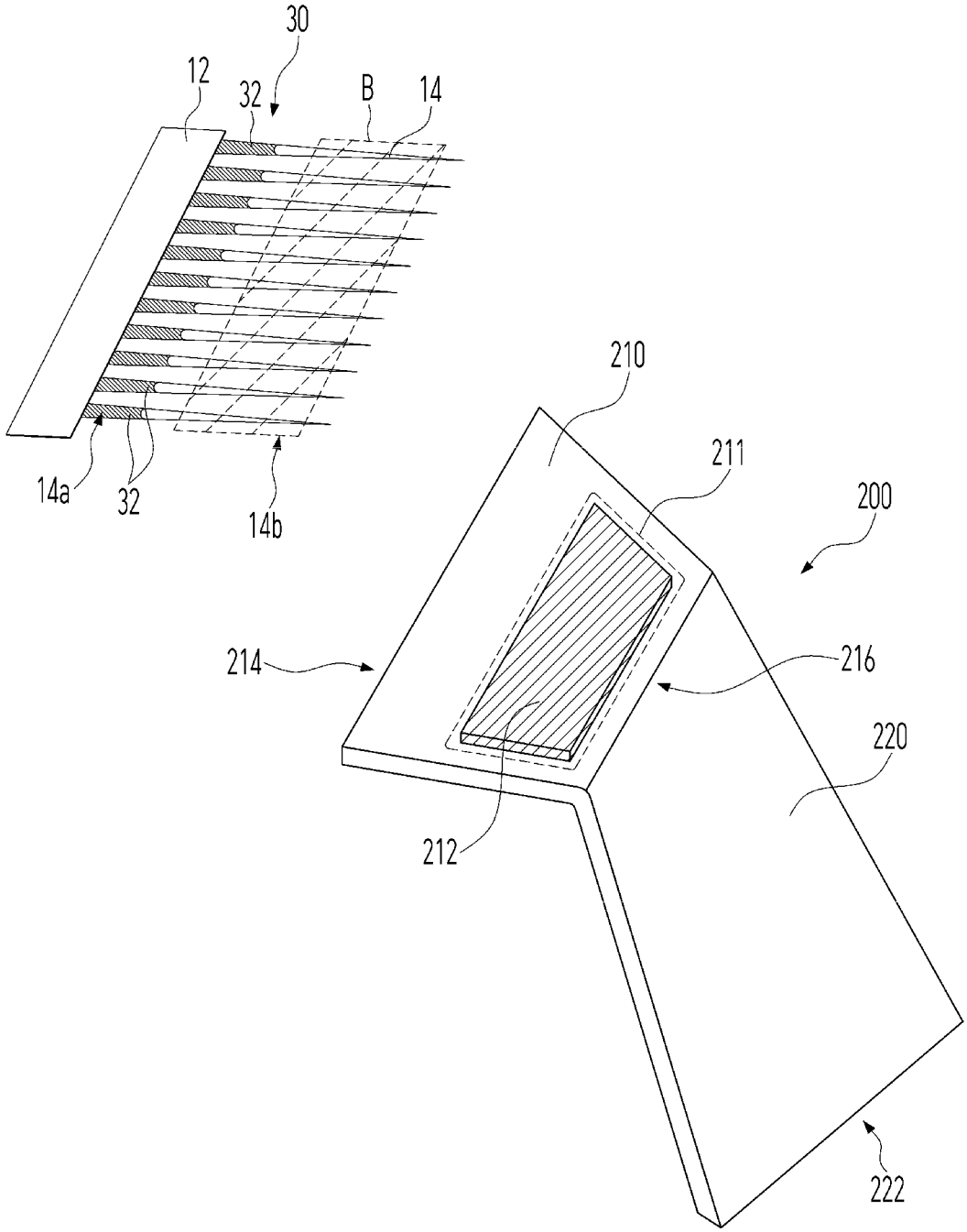
FIG. 5 is a perspective view of an embodiment of the applicator of FIGS. 2 and 4A to which the artificial eyelash extension system of FIG. 1B to be temporarily fixed.

FIG. 5 is a perspective view of an embodiment of the applicator of FIGS. 2 and 4A to which the artificial eyelash extension system of FIG. 1B to be temporarily fixed. FIG. 5 shows the lash extension system shown in FIG. 1B and the applicator 200 shown in FIGS. 2 and 4A, but the embodiment of the present invention is not limited thereto.

Referring to FIG. 5, the artificial eyelash extension system includes a plurality of eyelash filaments 14, a support strip 12 and a first adhesive (adhesive element) 32. For example, the first adhesive 32 may be formed on the first surface 14*a* (upward-facing surface) of the filaments 14, and the first adhesive 32 may be applied continuously from the support strip 12 and along the length of the filaments 14 to a predetermined position of the filaments 14. For example, the first adhesive is applied continuously from a position between the support strip 12 and a one-half of the filaments' average length to a distance that is equal to or less than one-half of the filaments' average length.

Further, the applicator 200 includes a tip portion 210 having an adhesive area 211 located on a predetermined portion of an upper surface thereof and a second adhesive 212 applied to the adhesive area 211; and a tab portion 220 connected to the tip portion 210 and gripped by a user. A second surface 14*b* (e.g., a downward-facing surface) of the filaments 14 of the artificial eyelash extension system 30 is temporarily fixed to the second adhesive 212.

The tip portion 210 and the tab portion 220 of the applicator 200 may be connected in a bent form while having a predetermined angle. For example, the predetermined angle may be an acute angle smaller than 90 degrees as shown.

The tip portion 210 includes a first edge 214 located adjacent to the support strip 12 of the artificial eyelash extension system 30 to be attached thereof and a second edge 216 located on the opposite side of the first edge 214 and connected to the tab portion 220.

As illustrated above, the first edge 214 has a first width w1, and the second edge 216 has a second width w2 smaller than the first width w1. For example, the tip portion 210 may have a shape in a trapezoidal shape in which the width becomes narrower from the first edge 214 to the second edge 216, and the tip portion 210 may have a first length h1 as shown in FIG. 2.

Further, as shown in FIG. 2, the adhesive area 211 of the tip portion 210 is spaced apart from the first edge 212 by a first distance a, and as shown in FIG. 4A, the second surface 14*b* (downward-facing surface) of the filaments 14 of the artificial eyelash extension system 30 is attached (or temporarily fixed) by the second adhesive 212 disposed on the adhesive area 211. In the embodiment, the filaments portion (B) which is temporarily fixed (or attached) to the second adhesive 212 does not overlap with the first adhesive 32 formed on the first surface 14*a* of the filament 14.

Specifically, referring to FIG. 5, in the artificial eyelash extension system 30 which is temporality fixed to the tip portion 210, the first adhesive 32 is disposed on the first surface 14*a* (upward-facing surface) of the filament 14 and portions of filaments 14 to which the first adhesive 32 are applied may be positioned between the first edge 214 and the adhesive area 211.

For example, the first adhesive 32 disposed on the first surface 14*a* of the filaments 14 and the second adhesive 212 disposed in the adhesive area 211 of the tip portion 210 may be spaced apart by a second distance b as shown in FIG. 4A. Therefore, when viewed in cross section, the first adhesive 32 and the second adhesive 212 do not overlap each other.

The applicator 200 according to an embodiment of the invention is characterized in that the adhesive strength of the second adhesive 212 is smaller than the adhesive strength of the first adhesives 20 and 32, thereby easily attaching and detaching artificial eyelash extension systems to a user's natural eyelash with one touch by the user.

In other words, when the user holds the tab portion 220 and pushes the tip portion 210 toward the user's natural eyelashes, the first surfaces of the filaments 14 on which the first adhesive 20 are attached to the user's natural eyelashes. Then, due to the relatively lower adhesive strength of the second adhesive 212 applied between the second surface of the filaments 14 and the adhesive area of the tip portion 210, the user can easily detach the applicator 200 from the lash extension system 30.

Figure 6:
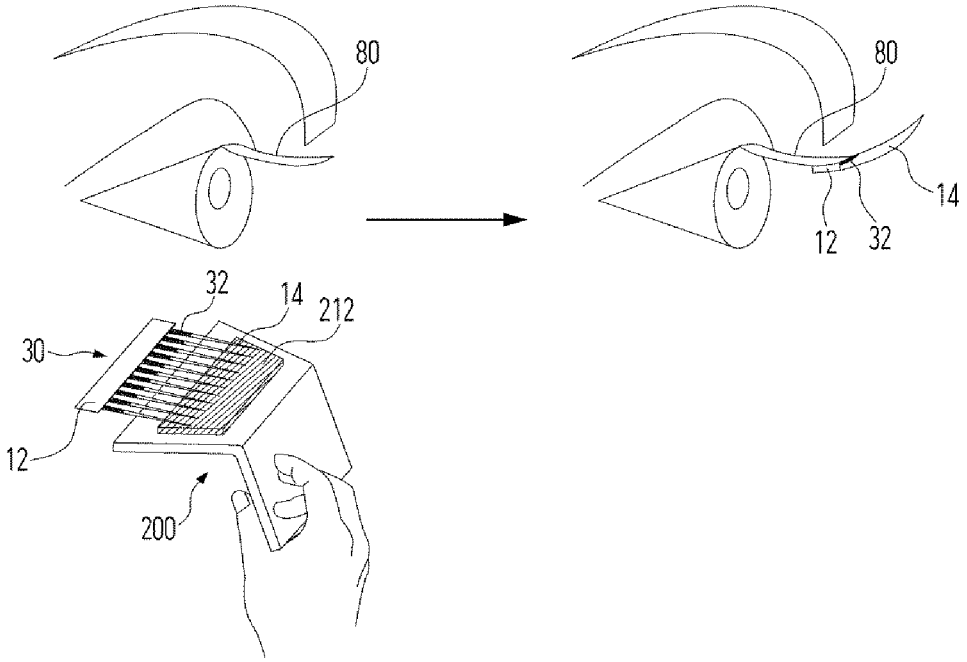
FIG. 6 is a schematic diagram of an embodiment of using the applicator for artificial eyelash extension systems shown in FIG. 5.

FIG. 6 depicts a schematic of a method of using the applicator 200 for the artificial eyelash extension system 30 shown in FIG. 5

The method for using the applicator 200 may comprise providing to a user the eyelash extension system 30 already having the first adhesive 32 disposed on the filaments 14 before being packaged for sale to the user and moving the first adhesive 32 of eyelash extension system 30 into contact with the user's natural eyelashes 80 by using the applicator 200. The step of moving the first adhesive 32 into contact with the user's natural eyelashes 80 may comprise contacting an underside of the user's natural eyelashes 80 with the first adhesive 32 disposed on the filaments 14.

As illustrated above, the user holds the tab portion 220 and pushes the tip portion 210 toward the user's natural eyelashes 80, thereby the first surfaces of the filaments 14 on which the first adhesive 32 are attached to the user's natural eyelashes 80. That is, the user moves the lash extension system 30 upward by using the applicator 200, so that the first adhesive 32 of the eyelash filaments 14 contact the user's natural lashes 80.

The first adhesive 32 of the lash extension system 30 contacts any portion of the underside of a user's natural lashes 80. Preferably, the first adhesive 32 may be put into contact with the user's natural lashes 80 such that the support strip 12 of the lash extension system 30 underlies the underside of a user's natural lashes 80 or their eyelid.

A salient feature of the instant invention is its ready-to-use nature. Prior art lash systems require applying a bonding solution to the lash extensions and/or the natural lashes of a user before application. The pre-applied adhesive elements (i.e., the first adhesive 32) are suitable for immediate application to a user's lashes without further preparation of the lash extension system or the user's natural lashes.

After moving the lash extension system into contact with their natural lashes, the invented lash extension system 30 will stay in place without any further pressing using the invented applicator 200. Further, no additional bonding solutions need to be applied. Once the invented lash system 30 is in place, the user can use the applicator 200 to adjust the precise position of the lash extension system or firmly squeeze the adhesive elements (first adhesive 32) and natural lashes together. Surprisingly and unexpectedly, the inventors have discovered that the step of firmly pressing together their natural lashes and adhesive elements from the lash extension system are not necessary as it was in prior art systems. Similarly, the instant invention does not require the sandwiching of natural lashes between a lash extension system on the top of the lashes and one on the bottom of the lashes in order to form a lasting bond as is found in the prior art. Another significant feature of the instant invention is that the lash extension systems described herein can be applied using only one hand.

After the application step in FIG. 6, the user may wear the invented lash extension system 30 for a period of up to 24 hours. After wearing, the user then grasps the unattached end of the worn lash extension system and gently pulls downward in order to remove the lash extension system from their eyelashes. The lash extension systems can then be stored for reuse. The lash extension systems, once removed, can be reused until their associated adhesive elements wear out. Alternatively, the original adhesive elements of the invented lash extension system can be rejuvenated or removed and replaced with new adhesive elements. Where a user removes the original adhesive elements from the invented lash extension system, the stripped system can then continue to be used as a lash extension system wherein a user applies their own glue.

The figures show the eyelash extension system having a length that approximates the length of a user's eyelid. This is exemplary and not meant to be limiting. In an embodiment, a user will apply only one lash extension system that removably underlies all or substantially all of a user's natural lashes. In such an embodiment, a user needs only apply one eyelash extension system to their natural lashes. In alternative embodiments, the length of the support strips will be shorter and will require a user to apply more than one lash extension system in order to removably underlie all or substantially all their lashes. In yet another embodiment, a user will cut a longer strip of lash extension systems into a plurality of lash extension systems having desired lengths, forming a cluster of lash extension systems.

In one embodiment, the steps of use include applying additional glue, drying, and applying heat. The heat-activated adhesive becomes more pliant when heated. In this embodiment, the users will apply heat by using a heat applicator. In one embodiment, the heat applicator is a small heater included in the package. In another embodiment, the source of heat is a force-activated heat pack. In another embodiment, the heat source comprises a layer of material that heats up when exposed to the electromagnetic radiation found in a microwave oven.

Figure 7A:
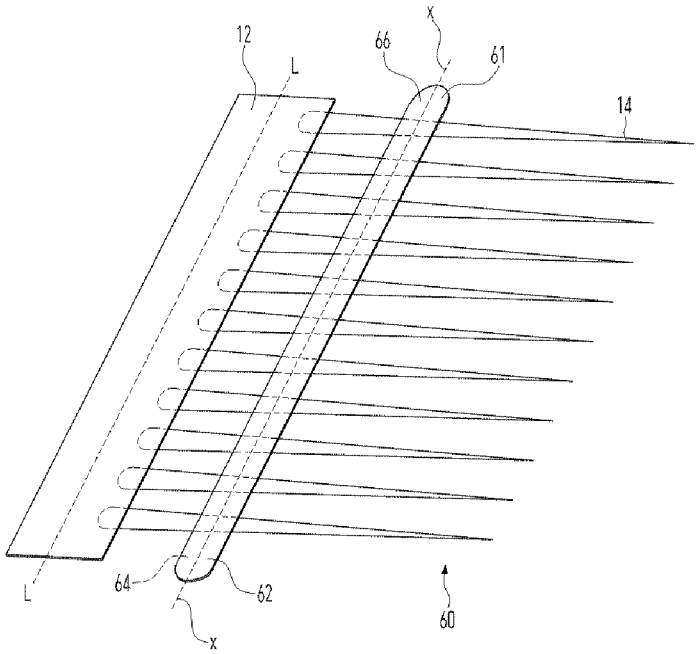
FIGS. 7A to 7C are perspective views of another embodiments of an artificial eyelash extension system having pre-applied adhesive elements.
Figure 7B:
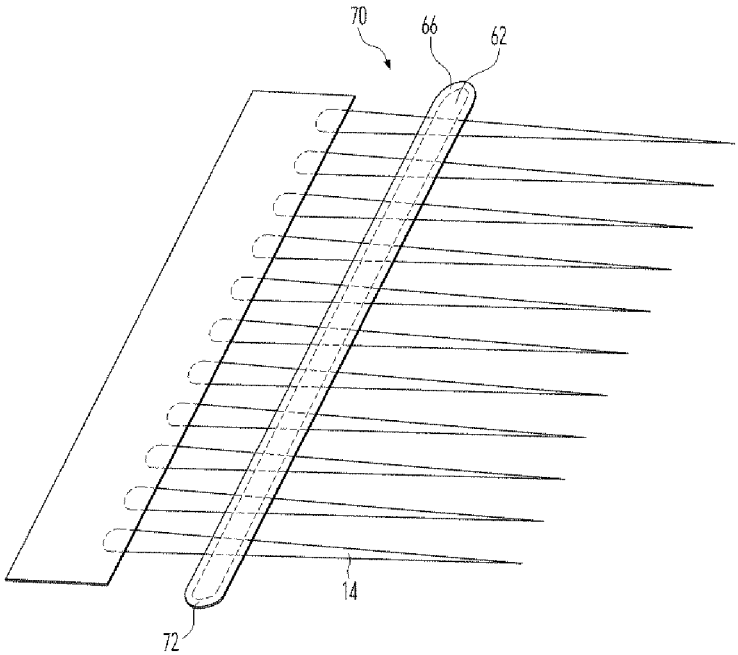
Figure 7C:
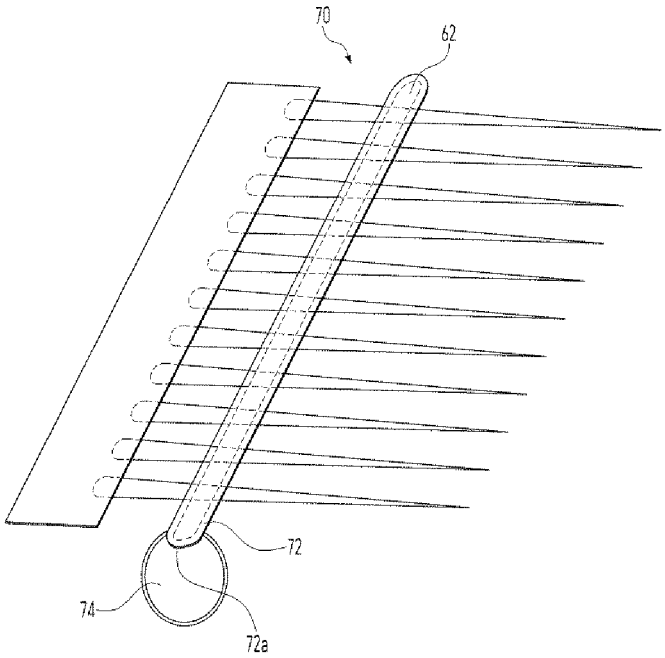

FIGS. 7A to 7C are perspective views of another embodiments of an artificial eyelash extension system having pre-applied adhesive elements.

Specifically, FIG. 7A depicts a perspective view of an embodiment of an eyelash extension system having an alternative pre-applied adhesive element, FIG. 7B depicts a perspective view of the invention embodiment shown in FIG. 7A featuring a temporary overlayment of the adhesive elements, and FIG. 7C depicts a perspective view of the invention embodiment shown in FIG. 7B featuring an alternative embodiment of temporary overlayment of the adhesive elements.

FIG. 7A shows another embodiment 60 of the invented lash extension system. This embodiment 60 features the same configuration of eyelash filaments 14 and support strip 12 as the embodiment shown in FIG. 1A. In this embodiment, however, the adhesive element 61 in this embodiment 60 is an elongated substrate 62 disposed across the eyelash filaments 14 such that the longitudinal axis x of the elongated substrate 62 is parallel with the length L of the support strip 12. The elongated substrate 62 may also be shorter than the length L of the support strip 12.

As shown in FIG. 7A, the elongated substrate 62 is disposed across the eyelash filaments 14 in a direction perpendicular to the length of the eyelash filaments 14. The adhesive element 61 (i.e. the first adhesive) may comprise an elongated substrate 62 having a longitudinal axis, an upward-facing surface 66, a downward-facing surface 64, and an adhesive disposed on the upward-facing and downward-facing surfaces, wherein the adhesive on the downward-facing surface contacts the eyelash filaments. The adhesive used on the upward-facing and downward-facing surfaces of the elongated substrate may be different. The lash extension system or artificial eyelash extension system may be adapted for the removal of the elongated substrate from the user's eyelashes without removing the elongated substrate from the eyelash filaments. The downward-facing surface 64 of elongated substrate 62 is secured to the eyelash filaments 14. The upward-facing surface 66 of the elongated substrate 62 features an adhesive or other sticky substance disposed thereon.

A person having ordinary skill in the art will readily appreciates that the elongated substrate 62 can be positioned across the eyelash filaments 14 anywhere along their length. Preferably, the elongated substrate 62 is positioned with its centerline (line x in FIG. 7A) disposed on the eyelash filaments 14 at a position corresponding to one-third to one-half of the length of the eyelash filaments 14 extending from the support strip 12. This positioning of the elongated substrate 62 is exemplary and not meant to be limiting. The elongated substrate 62 can reasonably be positioned over any portion of the eyelash filaments 14.

The elongated substrate 62 can be any suitable material for overlaying the eyelash filaments 14 without overly weighing down the lashes and without bending the lashes when worn by a user. Suitable materials for the elongated substrate 62 include double-sided tape and other types of thin strips with adhesives applied to both sides.

A salient feature of this embodiment is the ability of a user to obtain the eyelash extension system 60 and use it without applying their own adhesives either to the system or their lashes. To enable this feature, the eyelash extension system 60 has to be ready to use when desired by a user. As such, the eyelash extension system 60 should not be stuck to undesired surfaces or objects and should feature clean adhesive disposed on the upward-facing surface 66 of the elongated substrate 62. As shown in FIG. 7B, in order to maintain the eyelash extension system 70 in a ready-to-use configuration, a backing (second elongated substrate) 72 is removably secured to the adhesive distributed over the upward-facing surface 66 of the elongated substrate 62.

The system overlaid by the backing 72 is shown in the embodiment 70. This backing 72 is a temporary overlayment on the adhesive on the upward-facing surface of the elongated substrate 62 that prevents the eyelash extension system from sticking to undesired objects or becoming entrained with debris that would undermine the stickiness or appearance of the adhesive.

The backing 72 is double-sided in one embodiment. The backing 72 can be removably secured to the adhesive distributed over the upward-facing surface 66 of the elongated substrate 62, can be made from any material suitable for the temporary overlayment of the adhesive on the elongated substrate 62. Suitable materials include paper, plastic, fiber, and combinations thereof.

In an embodiment featuring the backing 72, the bond between the backing 72 and the first elongated substrate 62 is weaker than the bond between the first elongated substrate 62 and the eyelash filaments 14. This can be accomplished by forming a permanent bond between the first elongated substrate 62 and the eyelash filaments 14 and a temporary one between the backing 72 and the first elongated substrate 62. Alternatively, the adhesive contacting surface of the backing 72 is scored, frosted, or otherwise treated to prevent over sticking. These configurations are exemplary and not meant to be limiting. A person having ordinary skill in the art will understand that any configuration is suitable wherein the second elongated substrate (backing 72) can be removed from overlayment of the first elongated substrate 62 without ripping the first elongated substrate 62 from the eyelash filaments 14.

FIG. 7C shows the embodiment 70 of the invented eyelash extension system shown in FIG. 2B with the addition of an element that facilitates the removal of the backing 72 from the elongated substrate 62. As shown in FIG. 7C, the backing 72 can feature a terminating end 72*a* that extends past the periphery of the lash extension system and defines a tab 74. The tab 74 of the backing 72 can be the same shape as the rest of the backing 72. Alternatively, as shown in FIG. 7C, the tab of the backing 72 can feature a different and larger shape, such as a circular shape that gives a user a larger area to grab. In use, a user can grab the tab 74 and pull it toward the opposing end of the backing 72 to remove the backing 72 from the eyelash extension system.

FIGS. 8A to 8K are perspective views of still another embodiments of an artificial eyelash extension system having pre-applied adhesive elements.

Figure 8A:
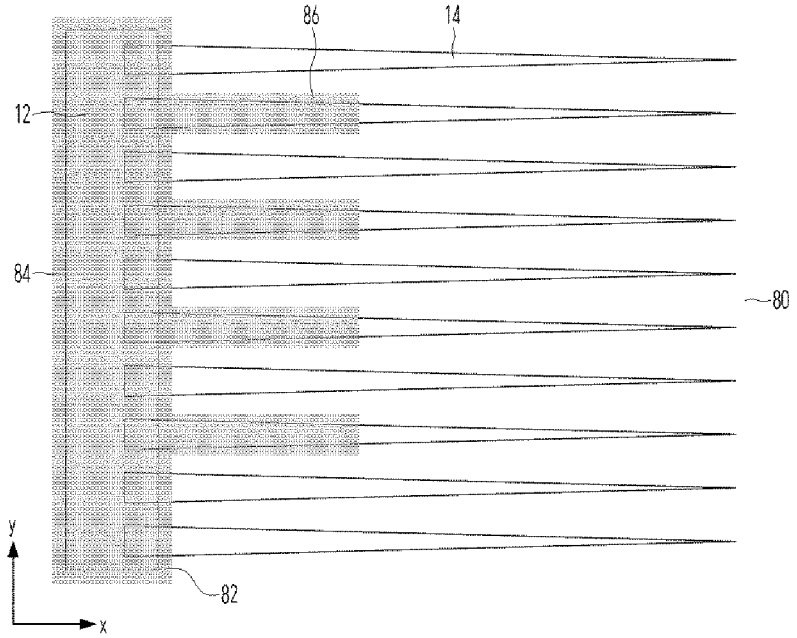
FIGS. 8A to 8K are perspective views of still another embodiments of an artificial eyelash extension system having pre-applied adhesive elements.

FIG. 8A shows another embodiment of an invented artificial eyelash extension system having an adhesive element. The artificial eyelash extension system 80 of this embodiment features the same configuration of eyelash filaments 14 and support strip 12 as the embodiment shown in FIG. 1A. In this embodiment, however, an adhesive element 82 having a fork shape including a head 84 and a plurality of spears 86 is disposed on the artificial eyelash extension system 80.

As shown in FIG. 8A, the head 84 of the adhesive element 82 is disposed to cover one side of the support strip 12 along the longitudinal direction of the support strip 12 (i.e., y-axis). Further, in FIG. 8A, a plurality of spears 86 are disposed to cover one side of the eyelash filaments 14 along the longitudinal direction of the eyelash filaments 14 (i.e., x-axis). The adhesive element 82 having the head 84 and the plurality of spears 86 may be configured as a single adhesive substrate. Otherwise, the adhesive element 82 may be configured as separate adhesive substrates combined. In one embodiment (not shown), the head 84 and respective spears 86 may each be a single adhesive substrate separated from each other. In another embodiment (not shown), separate adhesive substrates, which respectively include one or more of spears 86 and a part of the head 84, may be combined to form the adhesive element 82.

The adhesive element 82 may be any suitable adhesive material, such as, for example, a double-sided tape, a glue sticker, etc. The adhesive element 82 has an upward-facing surface and a downward-facing surface, wherein the downward-facing surface contacts the eyelash filaments 14. Further, the downward-facing surface has an adhesive property that can be secured to the support strip 12 and/or the eyelash filaments 14, and the upward-facing surface has an adhesive property that can be put in contact with the user's natural eyelashes such that the artificial eyelash extension system 80 can adhere to a user's natural eyelashes (e.g., the underside of the user's natural eye lashes).

In one embodiment, the strength of adhesion of the upward-facing surface and the strength of adhesion of the downward-facing surface may be same or different. For example, the strength of adhesion of the upward-facing surface and the strength of adhesion of the downward-facing surface may be determined such that the adhesive element 82 does not detach from the artificial eyelash extension system 80 while allowing the user to easily wear or remove the artificial eyelash extension system 80 from the user's natural eyelashes without applying their own adhesives either to the artificial eyelash extension system 80 or the user's natural eyelashes. The x-axis dimension and the y-axis dimension of the head 84 and the x-axis dimension and the y-axis dimension of the spear 86 are not limited to those illustrated in FIG. 8A, and they may be variously determined according to the particular style of an artificial eyelash extension system. For example, the x-axis dimension or the y-axis dimension of the head 84 may be less than, respectively, the x-axis dimension or the y-axis dimension of the support strip 12.

Further, the x-axis dimension of the spear 86 may be greater than the x-axis dimension of some of the eyelash filaments 14. Although FIG. 8A shows that the adhesive element 82 comprises four spears 86, the present embodiment is no limited thereto, and the adhesive element 82 may comprise any number of spears 86.

The adhesive element 82 may be manufactured, packaged, transported and stored separately from the artificial eyelash extension system 80 prior to being combined with the artificial eyelash extension system 80. That is, during the manufacturing process, the adhesive element 82 is combined with an artificial eyelash extension system 80 so that users can wear it without applying their own adhesive.

FIGS. 8B-8K are diagrams showing various other embodiments of the artificial eyelash extension systems having adhesive elements. For simplicity, portions overlap ping with those described above with reference to FIG. 8A will be omitted, but the omitted portions can be similarly applied to the below embodiments of FIGS. 8B-8K.

Figure 8B:
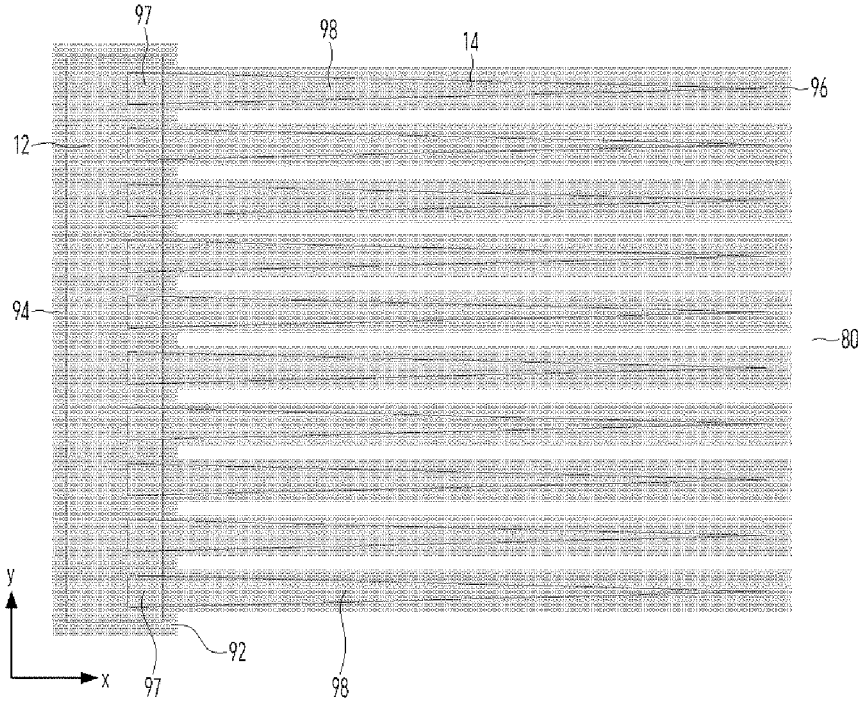

FIG. 8B shows an embodiment having a same configuration as that of FIG. 8A except that a plurality of spears 96 included in an adhesive element 92 are disposed along the y-axis dimension of the support strip 12 so that the roots 97 of the eyelash filaments 98 at both ends of the support strip 12 are covered by the spears 96. As mentioned above in FIG. 8A, the x-axis dimension and the y-axis dimension of the head 94 and the x-axis dimension and the y-axis dimension of the spear 96 are not limited to those illustrated in FIG. 8B, and they may be variously determined according to the particular style of an artificial eyelash extension system.

Figure 8C:
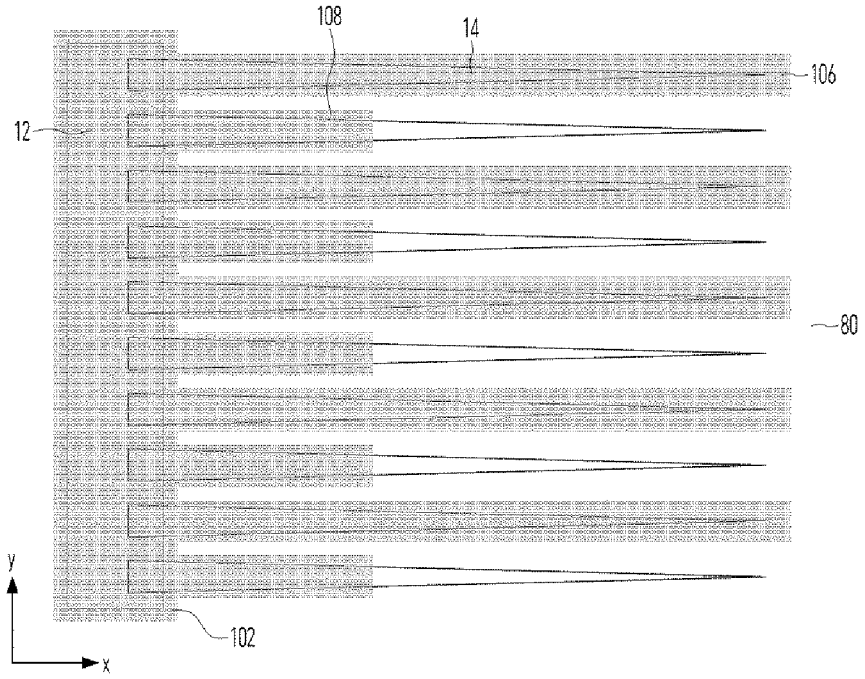

For example, although FIG. 8B shows that the x-axis dimension of the spear 96 is greater than that of the eyelash filament 14, the embodiment is not limited thereto and the x-axis dimension of the spear 96 may be less than that of the eyelash filaments 14. FIG. 8C shows an embodiment, in which an adhesive element 102 has spears 106, 108 of various lengths. The adhesive element 102 is configured by alternatively arranging long spears 106 having the first length and short spears 108 having the second length on the eyelash filaments 14, wherein the first length is longer than the second length in x-axis. The ratio of the numbers of the long spear 106 and the short spear 108 illustrated in FIG. 8C is merely an example, and the present embodiment is not limited thereto, and the ratio of the numbers of the long spear 106 and the short spear 108 may be variously determined according to the particular style of an artificial eyelash extension system. Likewise, there may be two or more spears of a certain length followed by two or more spears or another length (e.g., FIGS. 8D and 8E), multiple spears of multiple lengths, or any other arrangement where the spears have varying lengths from one another.

Figure 8D:
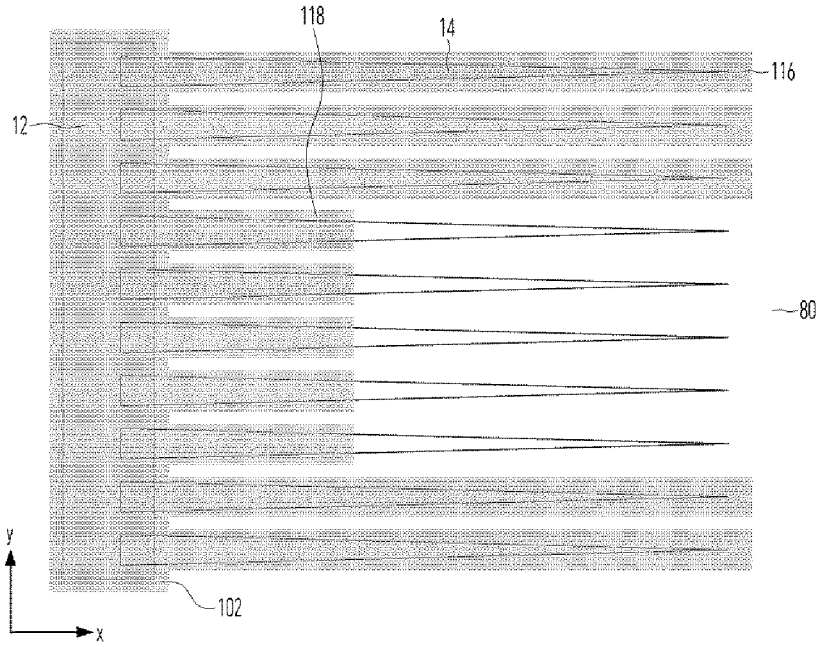

FIG. 8D shows an embodiment, in which an adhesive element 112 is configured to form the arch shape as a whole by appropriately arranging long spears 116 having the first length and short spears 118 having the second length on the eyelash filaments 14, wherein the first length is longer than the second length in x-axis. The number and arrangement of the long spears 116 and the short spears 118 are not limited to those illustrated in FIG. 8D and the long spears 116 and the short spears 118 may be arranged with various modifications, including the adhesive element 112 shown in FIG. 8D, which forms the arch shape as a whole.

Figure 8E:
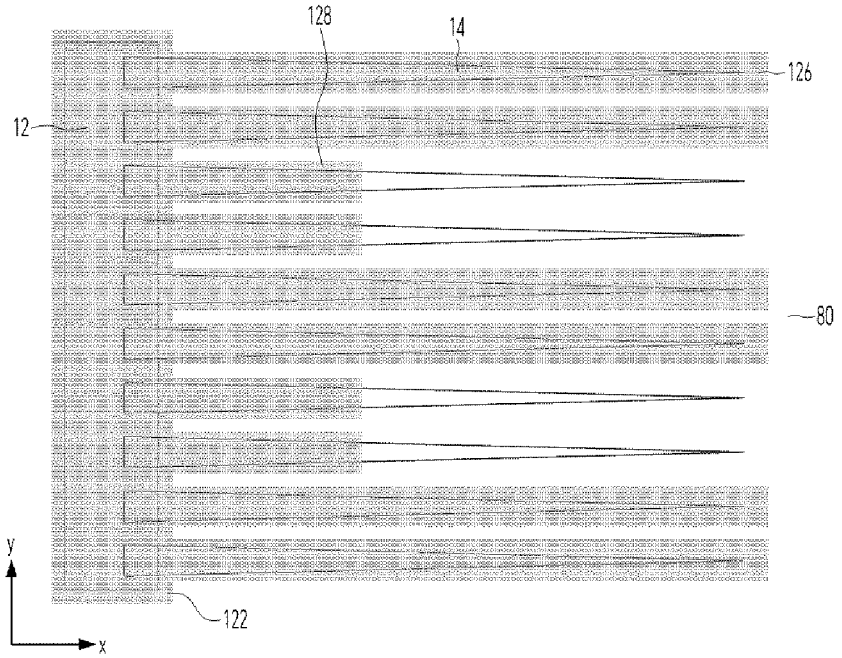

FIG. 8E shows an embodiment, in which an adhesive element 122 is configured by alternately arranging a group of long spears 126 having the first length and a group of short spears 128 having the second length on the eyelash filaments 14, wherein the first length is longer than the second length in x-axis. The groups of long spears 126 are arranged on the eyelash filaments 14 of both edges of the artificial eyelash extension system 80. In FIG. 4E, although the long spears 126 and the short spears 128 are grouped by two, the present embodiment is not limited thereto, and they may be grouped in various numbers according to an exemplary embodiment.

Figure 8F:
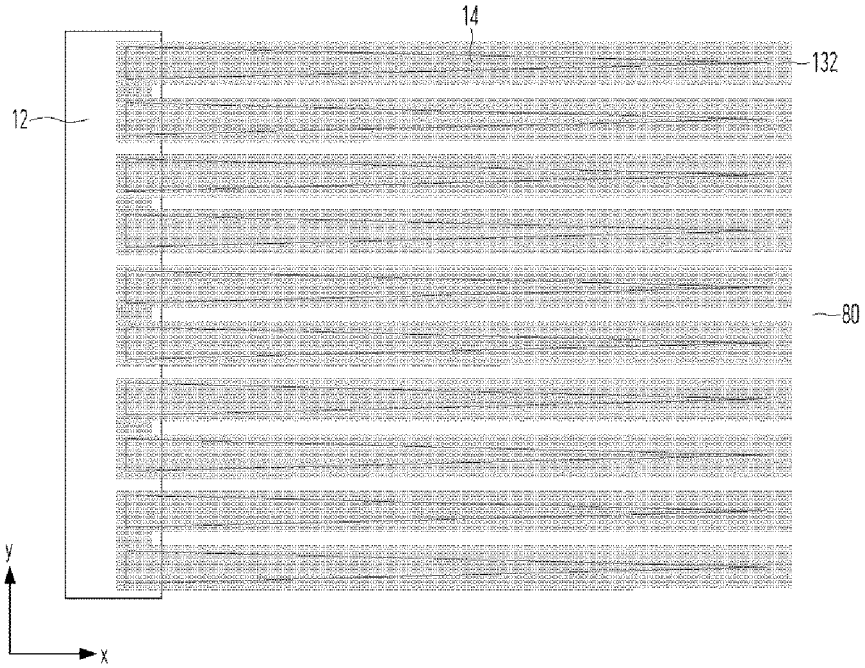

FIG. 8F shows another embodiment, in which a plurality of adhesive elements 132 having an angled-C shape are disposed on the artificial eyelash extension system 80. In one embodiment, each of the adhesive elements 132 may be configured as a single adhesive substrate. Otherwise, each of the adhesive elements 132 may be configured as separate adhesive substrates combined. Although FIG. 8F shows that the adhesive elements 132 are disposed to cover all of the eyelash filaments 14, the present embodiment is not limited thereto, and the number of the adhesive elements 132 may be determined to cover just some of the eyelash filaments 14.

Figure 8G:
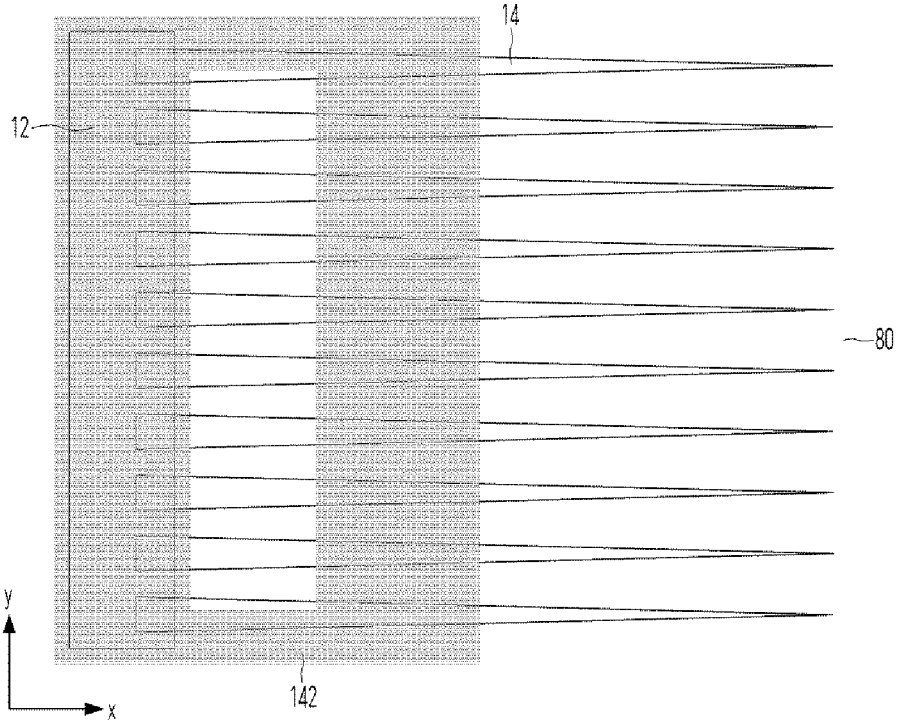

FIG. 8G shows an embodiment in which an adhesive element 142 having a rectangular shape is disposed on the artificial eyelash extension system 80. In one embodiment, the adhesive element 142 may be configured as a single adhesive substrate. Otherwise, the adhesive element 142 may be configured as separate adhesive substrates combined. Further, the x-axis dimension and y-axis dimension of each side of the adhesive element 142 are not limited to those illustrated in FIG. 8G, and they may be variously determined according to the particular style of an artificial eyelash extension system.

Figure 8H:
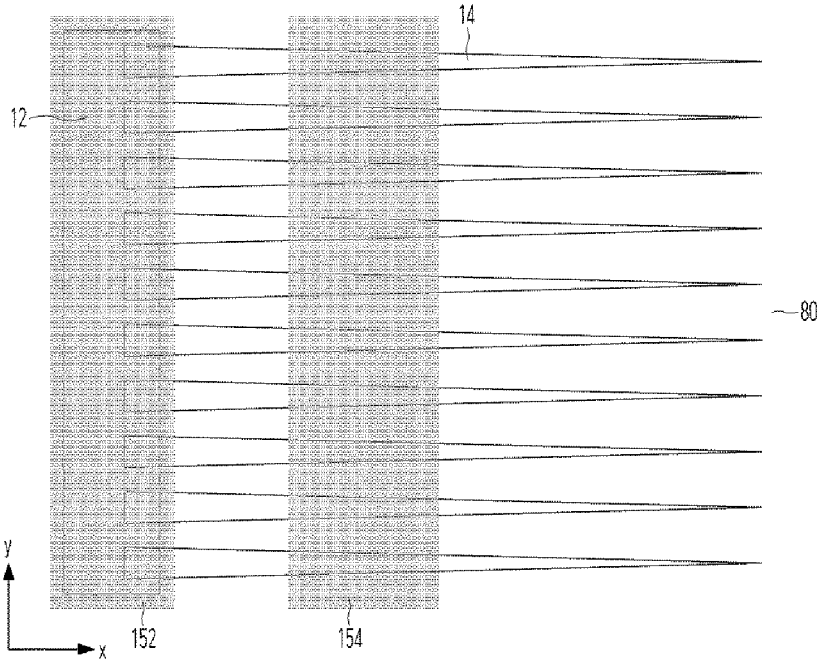
Figure 8I:
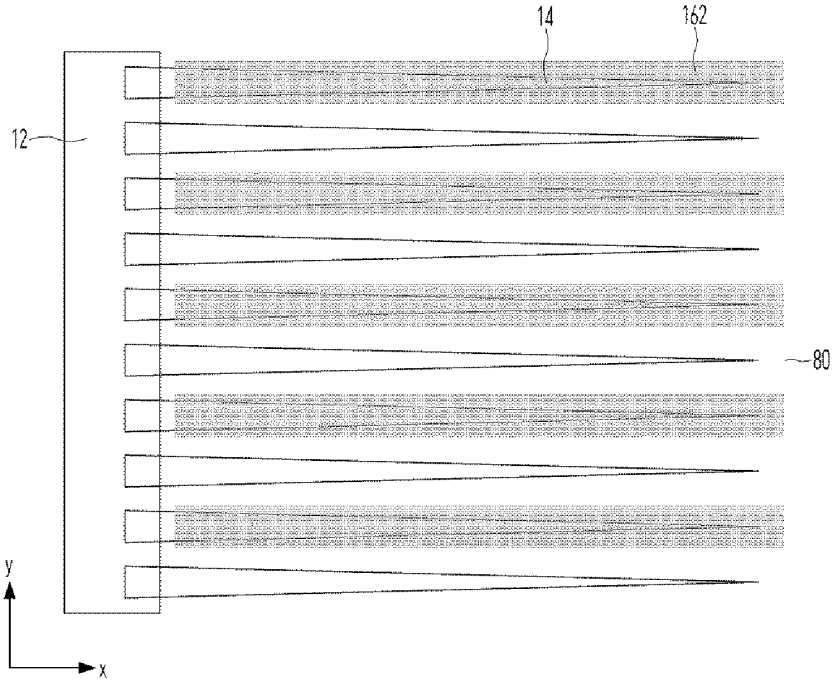
Figure 8J:
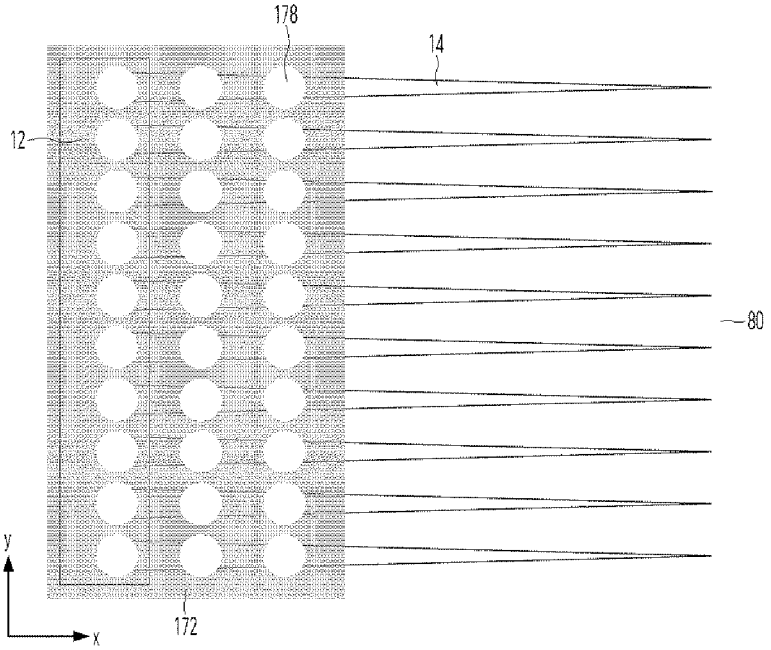

FIG. 8H shows an embodiment in which a first adhesive element 152 and a second adhesive element 154 are disposed on the artificial eyelash extension system 80. The first adhesive elements 152 are disposed on the artificial eyelash extension system 80 with a predetermined spacing from the second adhesive element 154. Otherwise, the first adhesive element 152 and second adhesive element 154 may be configured as a single adhesive substrate (as shown in FIG. 8J). Further, the x-axis dimensions and y-axis dimensions of the first and second adhesive elements 152, 154 are not limited to those illustrated in FIG. 8H, and they may be variously determined, respectively, according to the particular style of an artificial eyelash extension system.

FIG. 81 shows an embodiment in which a plurality of adhesive elements 162 are comprised of just the spears disposed on some of the eyelash filaments 14 without a head 84 of FIG. 8A disposing on the support strip 12. Although FIG. 81 shows that the plurality of adhesive elements 162 are arranged to cover about half of the eyelash filaments 162, the present embodiment is not limited thereto, and the plurality of adhesive elements 162 may be arranged to cover more or less than half of the eyelash filaments 14.

FIG. 8J shows an embodiment in which a perforated adhesive element 172 having a plurality of holes 178 is disposed on the artificial eyelash extension system 80. The perforated adhesive element 172 is a single piece, but it can be made from multiple pieces of adhesive elements combined. The number of holes 178 is not limited to those illustrated in FIG. 8J, and the number of holes 178 may be variously determined according to the particular style of an artificial eyelash extension system. Further, although the shape of the hole 178 is illustrated as a circular shape in FIG. 8J, the present embodiment is not limited thereto, and the hole 178 may have various shapes, including oval, diamond, square, etc.

Figure 8K:
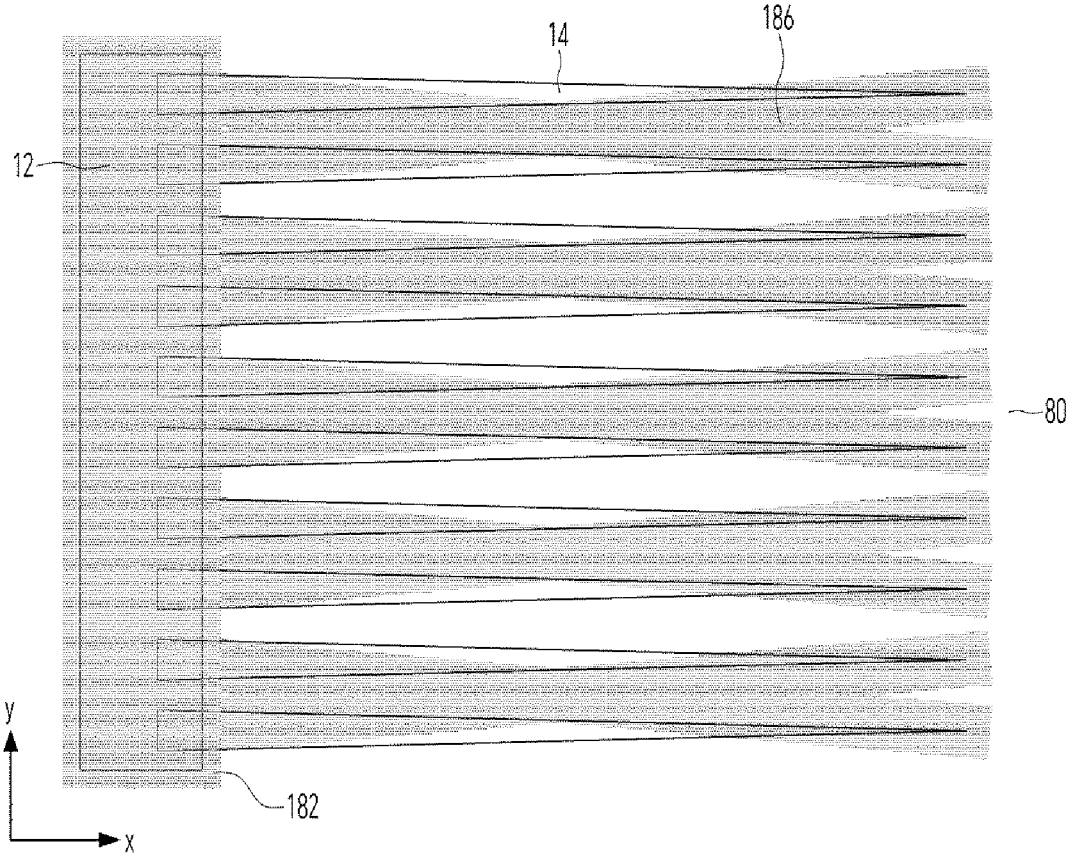

FIG. 8K shows an embodiment in which an adhesive element 182 is configured by arranging spears 186 to overlap and cross one another (e.g., forming an x-shape). The adhesive elements 182 may be configured as a single adhesive substrate. Otherwise, the adhesive element 182 may be configured as separate adhesive substrates combined.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. An applicator in combination with an artificial eyelash extension system, the artificial eyelash extension system comprising:

a plurality of eyelash filaments, each of the plurality of eyelash filaments comprising a base and a tip;

a support strip attached to the bases of the eyelash filaments; and a first adhesive disposed on the support strip and disposed on a portion of the plurality of eyelash filaments that continuously extend outward from the support strip, wherein the first adhesive is adapted to adhere to natural eyelashes of a user when the artificial eyelash extension system is applied, the applicator comprising:

a tip portion having a first edge located adjacent to the support strip of the artificial eyelash extension system to be attached thereof, a second edge located on the opposite side of the first edge, and an adhesive area located on a predetermined portion of an upper surface thereof, the adhesive area being spaced apart from the first edge, a second adhesive applied to the adhesive area; and a tab portion connected to the tip portion and configured to be gripped by a user, wherein:

a second surface of the filaments of the artificial eyelash extension system is temporarily fixed to the second adhesive, a second adhesive strength of the second adhesive is smaller than a first adhesive strength of the first adhesive, the first adhesive extends from the support strip along a first surface of the plurality of eyelash filaments and terminates at a predetermined position on the plurality of eyelash filaments, portions of the plurality of eyelash filaments to which the first adhesive is applied are positioned between the first edge and the adhesive area, and the second adhesive temporarily fixes the second surface of a portion of the plurality of eyelash filaments located between the predetermined position and the tips of the plurality of eyelash filaments.

2. The combination according to claim 1, wherein the tip portion and the tab portion are connected in a bent form with a predetermined angle.

3. The combination according to claim 2, wherein the predetermined angle is an acute angle smaller than 90 degrees.

4. The combination according to claim 2, wherein at least one of the tip portion and the tab portion has a curved shape which is convex outward when viewed in cross section.

5. The combination according to claim 1, wherein the first edge has a first width and the second edge has a second width smaller than the first width.

6. The combination according to claim 5, wherein the tip portion has a trapezoidal shape in which the width becomes narrower from the first edge to the second edge.

7. The combination according to claim 1, wherein the tab portion includes the second edge connected to the tip portion and a third edge located on the opposite side of the second edge, and the third edge has a third width greater than the second width.

8. The combination according to claim 7, wherein the tip portion has a first length and the tab portion has a second length greater than the first length.

9. The combination according to claim 1, wherein the tab portion has an opening at the center thereof.

10. The combination according to claim 1, wherein the tab portion has an elongated circular shape with curved edges when viewed in plan.

11. The combination according to claim 1, wherein the artificial eyelash extension system comprises a ready-to-use artificial eyelash extension system having the first adhesive which is a pre-applied adhesive element before being packaged for sale to a user.

12. The combination according to claim 1, wherein the first adhesive is applied at a position between the support strip and one-half the filaments' average length away from the support strip.

13. The combination according to claim 1, wherein the first adhesive comprises an adhesive that retains its stickiness during storage of the artificial eyelash extension system.

14. The combination according to claim 1, wherein the first adhesive is applied continuously from a position between the support strip and a one-half of the filaments' average length to a distance that is equal to or less than one-half of the filaments' average length.

15. The combination according to claim 1, wherein the first adhesive is a double-sided tape.

* * * * *